US007021363B2

(12) United States Patent
Gnass et al.

(10) Patent No.: US 7,021,363 B2
(45) Date of Patent: Apr. 4, 2006

(54) MOLD WALL, ESPECIALLY A BROAD SIDE WALL OF A CONTINUOUS CASTING MOLD FOR STEEL

(75) Inventors: Erwin Gnass, Norderstedt (DE); Gereon Fehlemann, Düsseldorf (DE)

(73) Assignee: SMS Demag, Dusseldorf ( * ) Notice: Subject to any disclaimer, the term of this patent is extended or adjusted under 35 U.S.C. 154(b) by 0 days.

(21) Appl. No.: 10/258,377

(22) PCT Filed: Apr. 20, 2001

(86) PCT No.: PCT/EP01/04491

§ 371 (c)(1),
(2), (4) Date: Oct. 23, 2002

(87) PCT Pub. No.: WO01/83136

PCT Pub. Date: Nov. 8, 2001

(65) Prior Publication Data

US 2003/0102104 A1 Jun. 5, 2003

(30) Foreign Application Priority Data

Apr. 27, 2000 (DE) ..... 100 20 551
Dec. 14, 2000 (DE) ..... 100 62 490

(51) Int. Cl.
*B22D 11/00* (2006.01)

(52) U.S. Cl. ..... 164/418; 164/72

(58) Field of Classification Search ..... 164/418, 164/443, 459, 72, 138, 268
See application file for complete search history.

(56) References Cited

U.S. PATENT DOCUMENTS

| | | | | |
|---|---|---|---|---|
| 4,037,646 | A * | 7/1977 | Hara et al. | 164/418 |
| 4,197,902 | A | 4/1980 | Von Jan et al. | |
| 4,911,225 | A * | 3/1990 | Leppanen | 164/459 |
| 4,987,020 | A * | 1/1991 | Bonnebat et al. | 428/65.3 |
| 5,230,380 | A * | 7/1993 | Sato | 164/418 |

OTHER PUBLICATIONS

Patent Abstract of Japan JP-55086658, Nov. 1978 continuous casting method.
Patent Abstract of Japan, JP-56039151, Sep. 1979 mold for continuous Casting Method.
Patent Abstract of Japan, JP-57031445. Jul. 1980,mold for continuous Casting Method.

* cited by examiner

*Primary Examiner*—Len Tran
(74) *Attorney, Agent, or Firm*—Abelman, Frayne & Schwab

(57) ABSTRACT

The invention relates to a mold wall for plate molds, tubular molds or similar, especially a broadside wall of a continuous casting mold for steel. The inventive plates consisting of copper or a copper alloy, which are either provided with coolant channels or are in thermally conductive contact with a water tank. Said plates have a surface which comes into direct contact with the steel melt and a protective layer applied to said surface. The wear resistance and mechanical workability are improved as a result of the protective layer consisting of a galvanically manufactured binary or ternary metal alloy dispersion, e.g. based on nickel with intercalated dispersants.

1 Claim, 1 Drawing Sheet

FIG.1
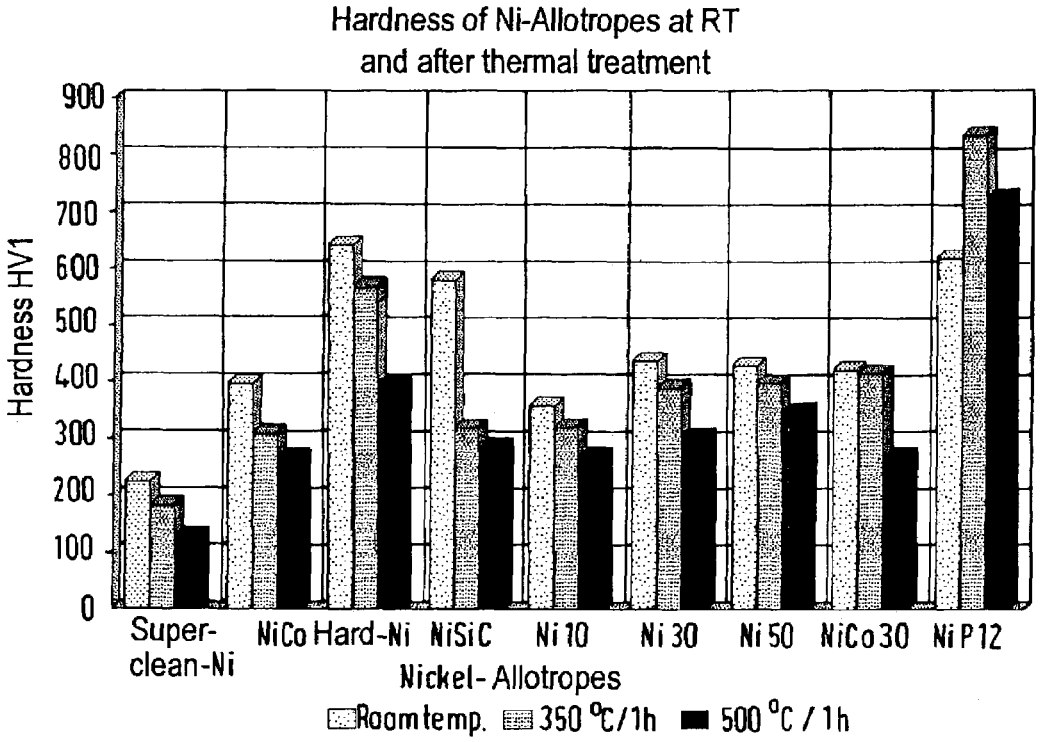
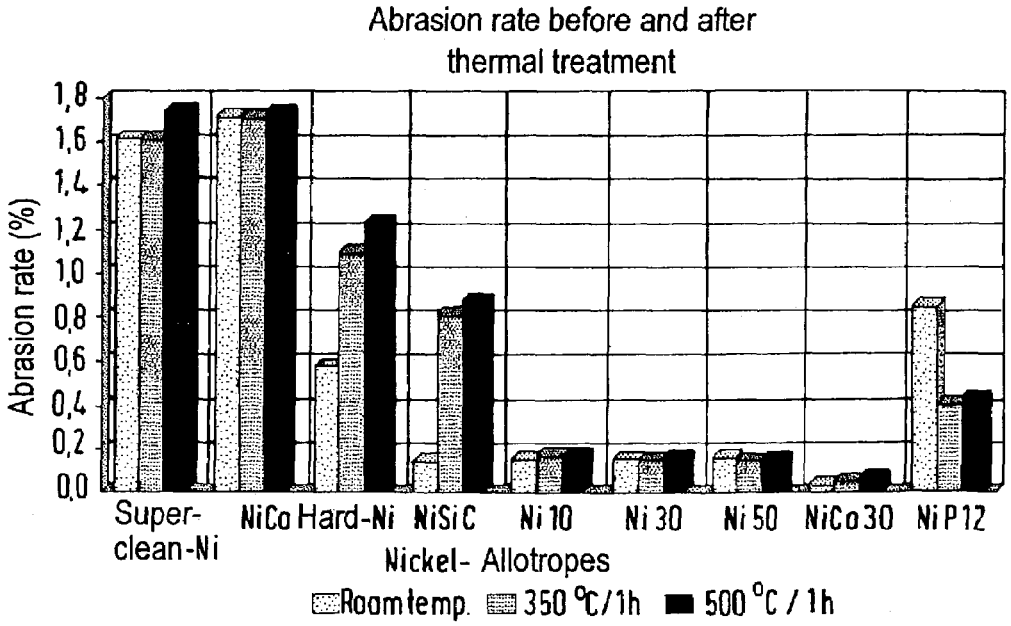
FIG.2

MOLD WALL, ESPECIALLY A BROAD SIDE WALL OF A CONTINUOUS CASTING MOLD FOR STEEL

The present invention relates to a mold wall for plate molds, tubular molds or the like, in particular, a broad side wall of a continuous casting mold for steel including plates of copper or a copper alloy which are either provided with coolant channels or are in a thermally conductive contact with a water tank and which have a surface that comes in a direct contact with steel melt and a protective layer applied thereto.

In order to increase wear resistance of the copper molds, such as Compact Strip Production mold plate, slab mold plates, tubular plates, and beam-blank molds, they are electroplated with chromium and/or nickel and, nowadays, also with nickel-cobalt alloys. These layers noticeably increase, due to their larger hardness and scaling resistance, the wear resistance of molds and, thus, lead to a noticeable increase of holding time.

Dependent on the use, these layers, which are applied to copper molds, have different thickness. The drawback of these layers consists in that they, because of their large hardness, can be mechanically treated only with much difficulty and, thus, their production is associated with comparatively large costs.

As a result, on many occasions, a compromise is sought between the wear resistance and the economical finish-treatment of the layers.

Further, the nickel hardness falls at increased temperatures by about 50%, and the hardness of nickel-cobalt and solid nickel by about 30%.

In the industry, e.g., in the production of racing motors or in tool production, since some time, nickel-silicon carbide-dispersion layers are used. Here, we deal with high wear resistant layers which at the same time have a high thermal resistance.

Tests have shown that the microstructure of metals or metal alloys can be, changed by inclusion of dispersing additives. In a plurality of cases, the change leads to the increase of the wear resistance and the thermal resistance. It is known that besides the silicon carbide particle, the inclusion of ultra diamonds also leads to the improvement of material characteristic, i.e., of wear resistance.

The grain size range of included dispersing additives varies from about 10 to 1000 nanometers in many practical application. The experiments also showed that the material characteristics resulting from dispersion are influenced by the size of the dispersing additives. Because of this, dependent on the load, different sizes of the dispersing additives are used.

A still non-laid open, German application DE-100 18 504.5 discloses use of hardenable copper alloys for molds. The invention consists in the use of a hardenable copper alloy for mold, in particular for producing broad side plates for thin slab continuous casting molds, and containing from 0.1% to 0.5% beryllium and from 0.5% to 2% nickel.

German Publication DE 26 34 633A1 discloses that in a continuous casting mold for casting steel and including a metal body provided with an inner layer of a wear-resistant material, the wear-resistant layer consists of electrolytically or electrolessly deposited metal layer with particles of a solid material, which does not dissolve in electrolytes, included in a crystal lattice. At that, a wear-resistant nickel layer can contain metal carbide particles included in the nickel lattice. Further, as a metal carbide, silicon carbide and as solid material particles, a diamond dust can be used. The solid material particles can also consist of metal oxides. The binary nickel dispersion layers are available with a hardness from about 380 to 450 HV1 and a high wear resistance at both room temperature and at a temperature from 350 to 500° C.

German Publication DE 198 01 728 C1 discloses a continuous casting mold for casting steel strands and consisting of mold plates and water tanks, which are connected with each other, between which water cooling is effected by using water conducting channels arranged in a side of a water tank adjacent to a mold plate. The mold is characterized in that the mold broad side elements such as the copper plate and the water tank with or without water conducting channels, but with a connection plate provided with water conducting channels, are held with coupling bolts with conical heads which are received in substantially conical recesses formed in the copper plate, and are held together with a tighting element.

Proceeding form this state of the art, the object of the invention is to so improve a mold plate for forming in particular, the broad side wall of a continuous casting mold for steel, with respect to its wear resistance at high temperatures upon contact with a steel melt and with respect to its economical treatment, e.g., smoothing, that the service life of the mold plate is significant by prove in comparison with the state of the art.

According to the invention, this object is achieved by forming the protective layer of the mold wall of the type discussed above of binary or ternary metal alloy dispersion produced by electroplating, on the basis of nickel with inclusion of dispersing additive. These measures significantly increase the processability and the wear resistant of so-called "hot face" of a mold wall.

Dependant on the load on the mold wall caused by steel grade, temperature, and/or turbulence of the melt in the mold, advantageously, materials such as cobalt, iron, zinc, copper, manganese, and chromium are added to nickel by electroplating as alloy components.

According to advantageous embodiment of the invention, it is contemplated to use as dispersing additives for further improvement of mechanical and physical properties of the protective layer:

a) carbides of titanium, tantalum, tungsten, zirconium, borum, chromium, and silicium;

b) oxides of aluminum, chromium, silicium, beryllium, and zirconium.

A significant advantage of the invention results from the fact that, e.g., nickel-cobalt-silicon carbide dispersion layer has, at high temperatures, e.g. in the range between 350 and 500° C., a much smaller reduction of the hardness than, e.g., super-clean nickel, nickel-cobalt, and hard nickel. The abrasion rate of nickel is 16 times higher than, e.g., abrasion rate of a binary nickel-cobalt-silicon carbide dispersion layer with 380 to 450 HV1, although the dispersion layer is only twice as hard as the super-clean nickel layer with 380 to 450 HV1 against 220 HV1.

In comparison with a nickel-silicium dispersion layer, the abrasion rate of a binary nickel-cobalt-silicon carbide dispersion layer amounts only to about 10%.

The basis for this difference consists, on one hand, in silicon carbide particles and, on the other hand, in the microstructure of the dispersion layers.

Despite the achieved high wear-resistance, the binary alloy dispersion layers can be economically treated because in comparison, e.g., with a hard nickel alloy with 600 HV1 at the room temperature, they have a hardness in the range between 380 and 450 HV1, within which they still economically treated, as experience has shown.

According to one embodiment of the invention, the binary or ternary nickel-alloy allotropes form a basis for, in particular, a multi-layer dispersion coating of mold plate inner surfaces.

A further embodiment of the invention is characterized in that both the mechanical and physical properties of a dispersion layer such as wear resistance, and/or thermal stability, and/or tribology are adjusted by changing the microstructure by varying the inclusion of nano size particles, in particular, silicon carbide particles.

This provides the operator with a possibility to select optimal conditions with respect to wear characteristics and economical treatment for existing loading of a mold wall.

Preferably, dispersing additives with particles sizes from 1μ to 5μ or nanosize particles with a size from 10–100 nanometers are used. The size and the inclusion rate of dispersion additive is selected, e.g., in accordance with tribological requirements.

According to a further embodiment of an inventive mold wall, for improvement to a most possible extent of mechanical properties of the protective layer, as dispersion additives, non-metallic solid materials, such as boron-nitride, boron-carbide, silicium-nitride, and ultra diamonds are used.

Finally, the mold wall according to the invention is characterized in that the dispersion layers have a thickness from 10–10.000μ which varies dependent on the load during casting and a necessary subsequent treatment.

The attached drawings show:

FIG. 1: a diagram illustrating hardness of Ni allotropes at room temperature or after a thermal treatment; and FIG. 2: a diagram illustrating abrasion rate before and after a thermal treatment.

The diagrams clarify big advantages of binary NiCo 30, nickel-cobalt silicon-carbide-dispersion with hardness of about 450 HVI in comparison with:

Ni (super-clean nickel)

NiCo (nickel-cobalt alloy)

Ni (hard nickel)

Nip 12 (electrolytically produced nickel alloy with more than 12% of phosphorus)

Nickel silicon carbide dispersion layers NiSiC with inclusion of 5% SiC

NiSiC dispersion with hardness of 360 HV1

NiSiC dispersion with hardness of 440 HV1

NiSiC dispersion form modified electrolytes with hardness of 420 HV.

The invention claimed is:

1. A mold wall of a continuous casting mold for steel and having plates of copper or a copper alloy and which are either provided with coolant channels or are in a thermally conductive contact with a water tank, the mold wall comprising:

a surface that comes in a direct contact with steel;

and a protective layer applied to the contact surface and having a thickness of from 10μ to 10,000μ, wherein the protective layer is formed of a binary nickel-cobalt alloy NiCo30 having a hardness of about 400 HV1 and includes dispersing additives with a particle of 1μ to 5μ or nanosize particles with a size of 10–1000 nanometers, wherein the dispersing additives are selected from a group containing:

a) carbides of titanium, tantalum, tungsten, zircomium, boron, chromium and silicon, and b) oxides of aluminum, chromium, silicium, beryllium, and zirconium, and wherein the dispersion layer has adjustable mechanical and physical properties such as wear resistance, and/or temperature resistance and/or tribology defined by a microstructure changeable by varying inclusion of nanosize particles of NiCo 30.

* * * * *